US009031492B2

(12) United States Patent
Oohara et al.

(10) Patent No.: US 9,031,492 B2
(45) Date of Patent: May 12, 2015

(54) IMAGE FORMING APPARATUS AND CURL CORRECTING METHOD

(71) Applicants: Shunichi Oohara, Kanagawa (JP); Yuko Hayama, Kanagawa (JP)

(72) Inventors: Shunichi Oohara, Kanagawa (JP); Yuko Hayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 194 days.

(21) Appl. No.: 13/752,517

(22) Filed: Jan. 29, 2013

(65) Prior Publication Data

US 2013/0195534 A1 Aug. 1, 2013

(30) Foreign Application Priority Data

Jan. 31, 2012 (JP) ..... 2012-018747
Nov. 12, 2012 (JP) ..... 2012-248521

(51) Int. Cl.
*G03G 15/00* (2006.01)

(52) U.S. Cl.
CPC ..... *G03G 15/6576* (2013.01)

(58) Field of Classification Search
CPC ..... G03G 15/6576; G03G 15/5029; G03G 15/235; G03G 2215/00776; G03G 2215/00772; B65H 2301/5121; B65H 2301/51256
USPC ..... 399/406, 44
See application file for complete search history.

(56) References Cited

U.S. PATENT DOCUMENTS 5,947,467 A * 9/1999 Billings et al. ..... 271/188
6,668,155 B1 12/2003 Hubble, III et al.
2005/0129431 A1 6/2005 Oohara et al.
2005/0260005 A1* 11/2005 Vanbortel et al. ..... 399/45
2006/0008283 A1 1/2006 Oohara et al.
2007/0071514 A1 3/2007 Yagi et al.
2007/0279447 A1 12/2007 Kawasaki et al.
2009/0196634 A1 8/2009 Satoh et al.

FOREIGN PATENT DOCUMENTS

JP 2002-316761 10/2002
JP 2006-023427 1/2006
JP 2011-081341 4/2011

OTHER PUBLICATIONS

European Search Report dated Jul. 4, 2013.

* cited by examiner

*Primary Examiner* — Blake A Tankersley
(74) *Attorney, Agent, or Firm* — Harness, Dickey & Pierce

(57) ABSTRACT

An image forming apparatus includes: a curl correction device which corrects curl generated in a recording medium having passed through a fixing device; a temperature/humidity sensor unit which is installed in a conveying path between the fixing device and the curl correction device, and detects and outputs temperature and humidity near a surface of the recording medium; a calculation unit which calculates temperature and moisture content of the recording medium from the temperature and humidity output values output from the temperature/humidity sensor unit, and calculates curl correction efficiency of the curl correction device from the temperature and moisture content of the recording medium; a control value determination unit which determines a control value to perform a curl correction in the curl correction device, based on the curl correction efficiency calculated by the calculation unit; and a control unit which controls the curl correction device by the control value.

10 Claims, 11 Drawing Sheets

FIG.5

| NIP TIME tc [SEC] | TYPE OF PAPER | MOISTURE CONTENT OF PAPER M [%] / TEMPERATURE OF PAPER T [°C] | M≤4 | 4<M≤6 | … | 16<M |
|---|---|---|---|---|---|---|
| tc≤0.02 | I1 | T≤20 | α111 | α112 | … | α11m |
| | | 20<T≤40 | α121 | α122 | … | α12m |
| | | 40<T≤60 | α131 | α132 | … | α13m |
| | | … | … | … | … | … |
| | | 100<T | α1n1 | α1n2 | … | α1nm |
| | I2 | T≤20 | α211 | α212 | … | α21m |
| | | 20<T≤40 | α221 | α222 | … | α22m |
| | | 40<T≤60 | α231 | α232 | … | α23m |
| | | … | … | … | … | … |
| | | 100<T | α2n1 | α2n2 | … | α2nm |
| | … | T≤20 | … | … | … | … |
| | | 20<T≤40 | … | … | … | … |
| | | 40<T≤60 | … | … | … | … |
| | | … | … | … | … | … |
| | | 100<T | … | … | … | … |
| | In | T≤20 | αi11 | αi12 | … | αi1m |
| | | 20<T≤40 | αi21 | αi22 | … | αi2m |
| | | 40<T≤60 | αi31 | αi32 | … | αi3m |
| | | … | … | … | … | … |
| | | 100<T | αin1 | αin2 | … | αinm |
| 0.02<tc≤0.04 | … | … | … | … | … | … |
| … | … | … | … | … | … | … |
| 0.1<tc | … | … | … | … | … | … |
| | In | … | … | … | … | … |
| | | 100<T | γin1 | γin2 | … | γinm |

FIG.7

| TYPE OF PAPER | MOISTURE CONTENT OF PAPER M [%] / TEMPERATURE OF PAPER T [°C] | M≤4 | | 4<M≤6 | | … | | 16<M | |
|---|---|---|---|---|---|---|---|---|---|
| PAPER I1 | T≤20 | Sz | Sz111 | Sz | Sz112 | Sz | … | Sz | Sz11m |
| | | S1, S2, S3, S4 | Si111 | S1, S2, S3, S4 | Si112 | S1, S2, S3, S4 | … | S1, S2, S3, S4 | Si11m |
| | | τ1 | τ1111 | τ1 | τ1112 | τ1 | … | τ1 | τ111m |
| | | τ2 | τ2111 | τ2 | τ2112 | τ2 | … | τ2 | τ211m |
| | | τ3 | τ3111 | τ3 | τ3112 | τ3 | … | τ3 | τ311m |
| | | τ4 | τ4111 | τ4 | τ4112 | τ4 | … | τ4 | τ411m |
| | 20<T≤40 | Sz121, Si121, τ1121, τ2121, τ3121, τ4121 | | Sz122, Si122, τ1122, τ2122, τ3122, τ4122 | | … | | Sz12m, Si12m, τ112m, τ212m, τ312m, τ412m | |
| | … | … | | … | | … | | … | |
| | 100<T | Sz1n1, Si1n1, τ11n1, τ21n1, τ31n1, τ41n1 | | Sz1n2, Si1n2, τ11n2, τ21n2, τ31n2, τ41n2 | | … | | Sz1nm, Si1nm, τ11nm, τ21nm, τ31nm, τ41nm | |
| … | T≤20 | … | | … | | … | | … | |
| | 20<T≤40 | … | | … | | … | | … | |
| | … | … | | … | | … | | … | |
| | 100<T | … | | … | | … | | … | |
| PAPER I2 | T≤20 | … | | … | | … | | … | |
| | 20<T≤40 | … | | … | | … | | … | |
| | … | … | | … | | … | | … | |
| | 100<T | Szin1, Siin1, τ1in1, τ2in1, τ3in1, τ4in1 | | Szin2, Siin2, τ1in2, τ2in2, τ3in2, τ4in2 | | … | | Szinm, Siinm, τ1inm, τ2inm, τ3inm, τ4inm | |

FIG.8

| PAPER | CURL AMOUNT Cr AFTER FIXATION [RADIUS mm] | REFERENCE CONTROL VALUE Xi | NIP WIDTH Ln [mm] |
|---|---|---|---|
| Ix1 | Cr≤40 | Xi11 | Ln11 |
| | 40<Cr≤60 | Xi12 | Ln12 |
| | 60<Cr≤80 | Xi13 | Ln13 |
| | 80<Cr≤100 | Xi14 | Ln14 |
| | 100<Cr≤120 | Xi15 | Ln15 |
| | 120<Cr≤150 | Xi16 | Ln16 |
| | 150<Cr≤200 | Xi17 | Ln17 |
| | 200<Cr≤300 | Xi18 | Ln18 |
| | 300<Cr≤400 | Xi19 | Ln19 |
| | 400<Cr≤500 | Xi110 | Ln110 |
| | 500<Cr | Xi111 | Ln111 |
| ... | ... | ... | ... |
| Ixn | Cr≤40 | Xin1 | Lnn1 |
| | 40<Cr≤60 | Xin2 | Lnn2 |
| | 60<Cr≤80 | Xin3 | Lnn3 |
| | 80<Cr≤100 | Xin4 | Lnn4 |
| | 100<Cr≤120 | Xin5 | Lnn5 |
| | 120<Cr≤150 | Xin6 | Lnn6 |
| | 150<Cr≤200 | Xin7 | Lnn7 |
| | 200<Cr≤300 | Xin8 | Lnn8 |
| | 300<Cr≤400 | Xin9 | Lnn9 |
| | 400<Cr≤500 | Xin10 | Lnn10 |
| | 500<Cr | Xin11 | Lnn11 |

IMAGE FORMING APPARATUS AND CURL CORRECTING METHOD

CROSS-REFERENCE TO RELATED APPLICATIONS

The present application claims priority to and incorporates by reference the entire contents of Japanese Patent Application No. 2012-018747 filed in Japan on Jan. 31, 2012 and Japanese Patent Application No. 2012-248521 filed in Japan on Nov. 12, 2012.

BACKGROUND OF THE INVENTION

1. Field of the Invention

The present invention relates to an image forming apparatus that forms an image by melting a toner, such as a copying machine, a printer, and a MFP, which uses electrophotographic technology, and a curl correcting method of correcting curl generated in a recording medium.

2. Description of the Related Art

Conventionally, an image forming apparatus using electrophotography causes an image carrier to hold charges on its surface by a charging device, forms a latent image on the image carrier by irradiating laser light or light emitting diode (LED) light from a light irradiation device according to image information, and develops the latent image by a toner supplied from a developing device. A toner image on the image carrier is transferred onto a transfer belt by a transfer device and is then transferred from the transfer belt to paper which is a recording medium. The toner image on the paper is fixed on the paper by being heated and pressed by a fixing device.

The fixing device includes a heating roller which heats the toner image, and a pressing roller which presses the paper against the heating roller. The heating roller includes a heating source and is controlled at a constant temperature to melt the toner image. On the other hand, the pressing roller has no heating source. Even if the pressing roller has a heating source, the pressing roller is set to a temperature lower than that of the heating roller so as to reduce power consumption. For this reason, a temperature difference occurs on two sides of the paper which is one example of the recording medium. This temperature difference causes a difference in amount of evaporation of moisture between front and rear sides of the paper, and it causes a difference in shrinkage of front and rear sides. Thereby, curl is generated in the paper. Also, a nip portion bent along a conveying direction may be formed by increasing a contact area of the nip portion so as to sufficiently melt a toner or by making the heating roller and the pressing roller have different hardness so as to make the paper easily separate from a fixing member. In that case, curl replicating the shape of the nip portion is generated in the paper.

The curled paper causes a paper jam in a conveying path after fixation, bulkiness when storing in a discharging unit, or the like. Conventionally, a curl correcting apparatus may be used to correct such curl generated at the time of fixation. As the curl correcting apparatus, a curl correcting apparatus of a roller nip type including an elastic roller and a pressing roller which rotates while forming a curved nip portion by pressing the elastic roller is known. Also, a belt nip type curl correcting apparatus. The belt nip type curl correcting apparatus including a belt which rotates while being wound around a belt support roller, and a pressing roller which rotates while forming a curved nip portion by pressing the belt is known. In such a curl correcting apparatus, both types are configured to correct the paper into a curl-free state by passing the paper after fixation through the curved nip portion between the elastic roller or the belt and the pressing roller and deforming the paper in a direction opposite to a curled direction.

In such a curl correcting apparatus, a different state of curl generated after fixation results, depending on a paper type or a difference in a density of an image formed on the paper environmental humidity and/or the like. For this reason, conventionally, a correction amount of the curl correcting apparatus has been adjusted according to a predetermined parameter, such as the paper type and the image density.

Japanese Patent Application Laid-open No. 2002-316761 discloses an image forming apparatus which aims at performing an appropriate curl correction according to an environmental change or a paper type and is characterized in that a correction amount is calculated according to a surrounding environment or a paper type. More specifically, the technology of Japanese Patent Application Laid-open No. 2002-316761 acquires environmental information around an image forming unit by an environment information input unit, and adjusts a correction amount of paper by a curl correction unit, based on the acquired environmental information. Thereby, even when there is an environmental change, such as a change in ambient temperature or humidity, an appropriate curl correction can be performed. Also, the technology of Japanese Patent Application Laid-open No. 2002-316761 adjusts a correction amount according to a paper type which has been input in advance.

Also, Japanese Patent Application Laid-open No. 2011-081341 performs an exact curl correction by measuring a temperature or humidity near a surface of a transfer material having passed through a pressing portion of a fixing device and predicting an amount of curl formed later. More specifically, in the technology of Japanese Patent Application Laid-open No. 2011-081341, a detection unit which measures the temperature or humidity near the surface of the transfer material having passed through the pressing portion of the fixing device calculates a predicted curl amount from at least one physical quantity related to one or both of the temperature and the humidity, and sets a control value corresponding to the calculated predicted curl amount, so that a correction amount of paper by a curl correction unit is adjusted. Thereby, even when there is a change in a temperature state of the fixing device or a moisture state of the paper, an appropriate curl correction can be performed.

The curl correction device corrects curl by generating residual strain to remove the curl by using a viscoelastic characteristic of the recording medium (for example, paper, film, or the like) which is the transfer material. Therefore, the effect of the curl correction also changes according to the change in the viscoelastic characteristic of the recording medium. The viscoelastic characteristic changes according to the temperature and moisture content of the recording medium (for example, paper, film, or the like). When the fixing device is disposed upstream (previous process) of the curl correction device, the temperature of the heating roller changes according to the operating state of the image forming apparatus, for example, according to whether immediately after start-up or during continuous printing, or whether a color image or a monochromatic image. In particular, the temperature of the pressing roller having no heating source greatly changes. With the change in temperature, the moisture content of the recording medium (for example, paper, film, or the like) at the time of arrival at the curl correction device also changes. In order to accurately perform the curl correction of the recording medium, the correction depending on such a change is required. Therefore, in order to accurately remove the curl of the recording medium, it is necessary to accurately know the temperature and moisture content of the recording medium (for example, paper, film, or the like) before the correction in the curl correction device, that is, at the upstream of the curl correction device. Also, the curl correction according to the viscoelastic characteristic of the recording medium is required.

However, in the conventional technology disclosed in Japanese Patent Application Laid-open No. 2002-316761, since there is no perception that the effect of the curl correction changes according to the temperature and moisture content of the paper, an accurate correction is difficult even though the curl is corrected according to the environmental humidity. That is, in the conventional technology, in some operating situations of the image forming apparatus, the curl suppression effect may be low as compared with the actual curl amount or the suppression effect may be too adjusted so that the recording medium may be reversely curl, and there has been a problem that it is impossible to sufficiently cope with the change in the curl correction effect changing due to the viscoelastic characteristic of the recording medium.

On the other hand, also in the conventional technology disclosed in Japanese Patent Application Laid-open No. 2011-081341, since there is no perception that the effect of the curl correction changes according to the temperature and moisture content of the paper, an accurate correction is difficult even though the curl is corrected by estimating a curl amount from a physical quantity obtained by a detection unit. Therefore, as in the case of Japanese Patent Application Laid-open No. 2002-316761, there has been a problem that it is impossible to sufficiently cope with the change in the curl correction effect changing due to the viscoelastic characteristic of the recording medium.

Also, in order to predict the effect of the curl correction, data to calculate the effect of the curl correction peculiar to each recording medium is required. For example, paper is one example of the recording medium of an existing type but paper available in the market does not always have a constant characteristic. Therefore, the current characteristic may be different from the previous data. Also, if considering coping with new products, data to calculate the effect of the curl correction needs to be updated. Updating data on the image forming apparatus being already running in the market has a problem in that a lot of time and effort is required.

In view of the above problems, there is a need to provide an image forming apparatus and a curl correcting method, which can cope with changes in a temperature state or characteristic of a recording medium after a fixing device according to changes in the operating situation of the image forming apparatus, and realize an appropriate and accurate curl correction.

SUMMARY OF THE INVENTION

It is an object of the present invention to at least partially solve the problems in the conventional technology.

An image forming apparatus includes: a fixing device which causes a recording medium to pass through a heated pressing portion and fixes a toner image formed on the recording medium; a curl correction device which corrects curl generated in the recording medium having passed through the fixing device; a temperature/humidity sensor unit which is installed in a conveying path between the fixing device and the curl correction device, and detects and outputs temperature and humidity near a surface of the recording medium being conveyed; a calculation unit which calculates temperature and moisture content of the recording medium from temperature and humidity output values output from the temperature/humidity sensor unit, and calculates curl correction efficiency of the curl correction device from the temperature and moisture content of the recording medium; a control value determination unit which determines a control value to perform a curl correction in the curl correction device, based on the curl correction efficiency calculated by the calculation unit; and a control unit which controls the curl correction device by the control value determined by the control value determination unit.

A curl correcting method is performed by an image forming apparatus including a fixing device which causes a recording medium to pass through a heated pressing portion and fixes a toner image formed on the recording medium, and a curl correction device which corrects curl generated in the recording medium having passed through the fixing device. The curl correcting method includes: by a temperature/humidity sensor unit installed in a conveying path between the fixing device and the curl correction device, detecting and outputting temperature and humidity near a surface of the recording medium being conveyed in the conveying path; by a calculation unit, calculating temperature and moisture content of the recording medium from temperature and humidity output values output from the temperature/humidity sensor unit; by the calculation unit, calculating curl correction efficiency of the curl correction device from the temperature and the moisture content; by a control value determination unit, determining a control value to perform a curl correction in the curl correction device, based on the curl correction efficiency calculated by the calculation unit; and by a control unit, controlling the curl correction device by the control value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5 is a table to obtain curl correction efficiency;

FIG. 7 is a table to obtain a stress relaxation characteristic of a paper;

FIG. 8 is a table to obtain a reference control value of a curl correction device;

DETAILED DESCRIPTION OF THE PREFERRED EMBODIMENTS

Hereinafter, an embodiment of the image forming apparatus will be described. In addition, in the present embodiment, an image forming apparatus including a tandem type image forming unit with a color printing function will be described as an example.

Figure 1:
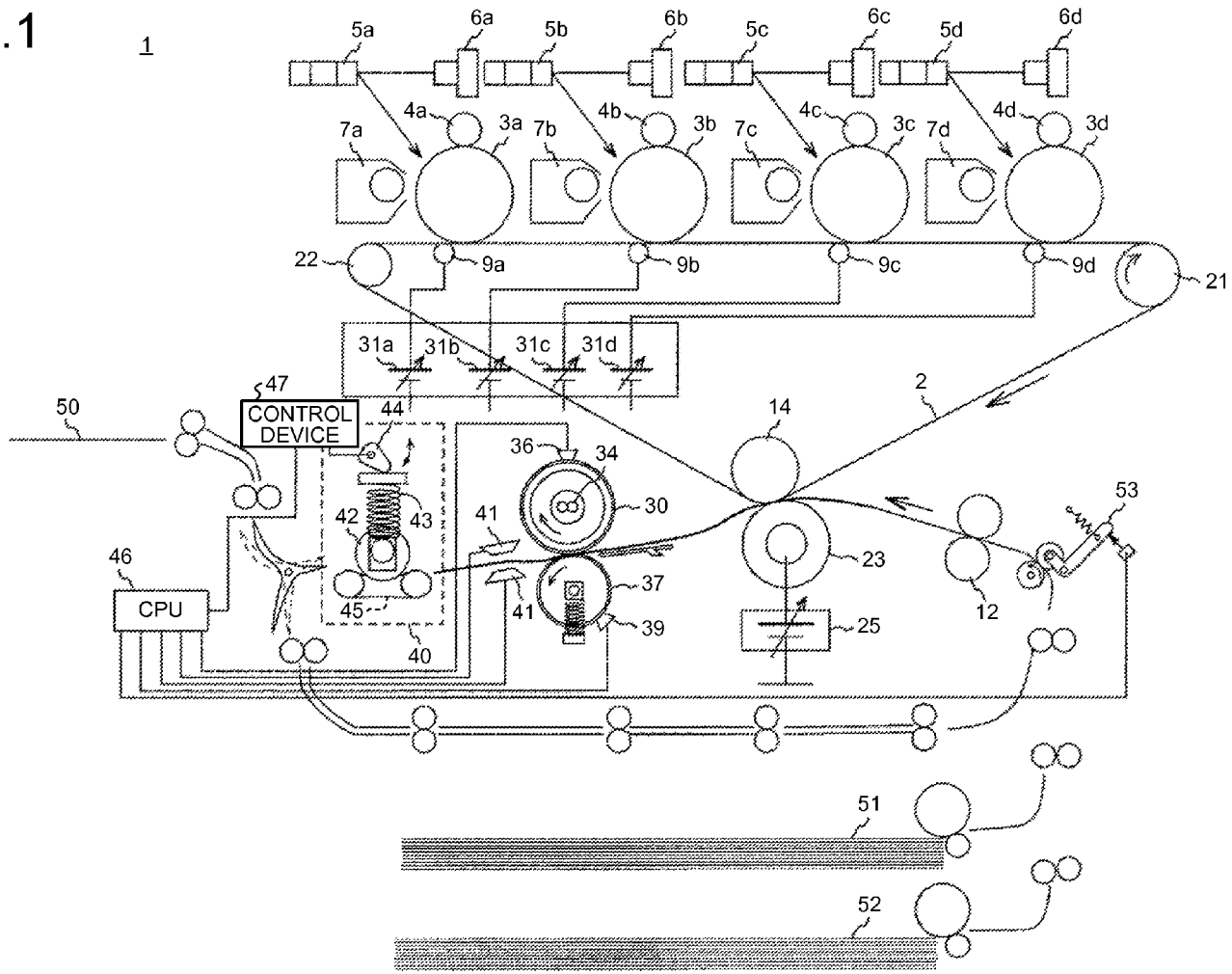
FIG. 1 is a diagram illustrating a schematic configuration of an image forming unit included in an image forming apparatus according to an embodiment.

FIG. 1 is a diagram illustrating a schematic configuration of an image forming unit included in an image forming apparatus according to the embodiment.

An image forming unit 1 illustrated in FIG. 1 includes photosensitive drums 3*a*, 3*b*, 3*c* and 3*d* and roller charging devices 4*a*, 4*b*, 4*c* and 4*d*, which are provided respectively for black (K), magenta (M), cyan (C), and yellow (Y) colors. The roller charging devices 4*a*, 4*b*, 4*c* and 4*d* charge the photosensitive drums 3*a*, 3*b*, 3*c* and 3*d* with charges, respectively. The photosensitive drums 3*a*, 3*b*, 3*c* and 3*d* for the respective colors are arranged side by side along an intermediate transfer belt 2.

The image forming unit 1 further includes light irradiation devices 6*a*, 6*b*, 6*c* and 6*d*, polygon mirrors 5*a*, 5*b*, 5*c* and 5*d*, and developing devices 7*a*, 7*b*, 7*c* and 7*d*, which are provided for the respective colors.

The light irradiation devices 6*a*, 6*b*, 6*c* and 6*d* include laser diodes or the like. The polygon mirrors 5*a*, 5*b*, 5*c* and 5*d* are driven to rotate at a constant high speed by a motor, which is not illustrated, and scan light beams in respective main scanning directions of the respective photosensitive drums 3*a*, 3*b*, 3*c* and 3*d*. The developing devices 7*a*, 7*b*, 7*c* and 7*d* hold respective developers.

In image forming processing, first, the photosensitive drums 3*a*, 3*b*, 3*c* and 3*d* are negatively charged by the roller charging devices 4*a*, 4*b*, 4*c* and 4*d*, respectively, so that the photosensitive drums 3*a*, 3*b*, 3*c* and 3*d* are uniformly charged.

Thereafter, light beams are output from the light irradiation devices 6*a*, 6*b*, 6*c* and 6*d* according to image signals decomposed into black (K), magenta (M), cyan (C), and yellow (Y), respectively. Thereby, electrostatic latent images are formed on the surfaces of the charged photosensitive drums 3*a*, 3*b*, 3*c* and 3*d* through optical systems including the polygon mirrors 5*a*, 5*b*, 5*c* and 5*d*, respectively. The electrostatic latent images of the respective colors, which are formed on the surfaces of the respective photosensitive drums 3*a*, 3*b*, 3*c* and 3*d*, are conveyed toward the developing devices 7*a*, 7*b*, 7*c* and 7*d* according to the rotation of the photosensitive drums 3*a*, 3*b*, 3*c* and 3*d*, respectively. Toners supplied from the developing devices 7*a*, 7*b*, 7*c* and 7*d* are attached to the electrostatic latent images of the surfaces of the photosensitive drums 3*a*, 3*b*, 3*c* and 3*d*, thereby forming toner images on the photosensitive drums 3*a*, 3*b*, 3*c* and 3*d*, respectively.

The intermediate transfer belt 2 stretched around the rollers 14, 21 and 22 is arranged under the photosensitive drums 3 (3*a*, 3*b*, 3*c*, 3*d*). The intermediate transfer belt 2 is moved in a direction of an arrow illustrated in the drawing.

The rollers 9*a*, 9*b*, 9*c* and 9*d* are arranged inside the intermediate transfer belt 2 and at positions facing the photosensitive drums 3*a*, 3*b*, 3*c* and 3*d*, respectively. The rollers 9*a*, 9*b*, 9*c* and 9*d* come into contact with the inside of the intermediate transfer belt 2, and are applied with primary bias voltages by power supplies 31*a*, 31*b*, 31*c* and 31*d*, respectively.

The toner images formed on the respective photosensitive drums 3*a*, 3*b*, 3*c* and 3*d* are conveyed toward the intermediate transfer belt 2 according to the rotation of the photosensitive drums 3*a*, 3*b*, 3*c* and 3*d*, respectively. At the positions where the respective photosensitive drums 3*a*, 3*b*, 3*c* and 3*d* come in contact with the intermediate transfer belt 2, the toner images on the photosensitive drums 3*a*, 3*b*, 3*c* and 3*d* are transferred onto the intermediate transfer belt 2 by the primary bias voltages of the rollers 9*a*, 9*b*, 9*c* and 9*d*, respectively.

In this case, the toner images on the respective photosensitive drums 3*a*, 3*b*, 3*c* and 3*d*, that is, the toner images of respective colors are superimposed in alignment, and the multicolor toner image is formed on the intermediate transfer belt 2. A toner remaining on the outer circumferential surface of the photosensitive drums 3, in which the transfer of the toner images is completed, is removed by a photosensitive drum cleaner, which is not illustrated. Then, the photosensitive drums 3 are neutralized by a neutralization device, which is not illustrated, and are supplied to a next image forming process.

The toner image on the intermediate transfer belt 2 is conveyed to a transfer roller 23 of a secondary transfer unit. On the other hand, a recording medium (for example, paper or film), which is a transfer material set in a paper cassette 51 or a paper cassette 52, is supplied (also called fed) toward the transfer roller 23 at a set timing. In this case, a thickness of the recording medium conveyed toward the transfer roller 23 is detected by a thickness sensor 53 arranged in the middle of a conveying path. The recording medium is delivered in a carriage roller 12 in timing such that an image is transferred in a predetermined area of the paper at the transfer roller 23.

Charges are supplied from the power supply 25 to the transfer roller 23, and the toner image on the intermediate transfer belt 2 is collectively transferred onto the recording medium by the electrostatic force. The recording medium, on which the toner image is formed, is supplied to a nip portion between a heated heating roller 30 and a pressing roller 37 of a fixing device, and the toner image is fixed on the recording medium by being heated and pressed.

The recording medium after the fixation is subjected to curl correction in a curl correction device 40, and is then discharged onto a discharging (or ejecting) tray 50 along a predetermined conveying path by an ejecting roller which is a discharging roller. After the toner image is transferred, a toner remaining on the intermediate transfer belt 2 is removed by a cleaning blade or the like, and the intermediate transfer belt 2 is then supplied to a next image forming process. Incidentally, in the present embodiment, the fixing device has been described as a device using roller-like members such as the heating roller 30 and the pressing roller 37, but the fixing device can also be configured using a belt-like member.

Hereinafter, the fixing device and the curl correction device will be described in detail with reference to FIGS. 1 and 2.

Figure 2:
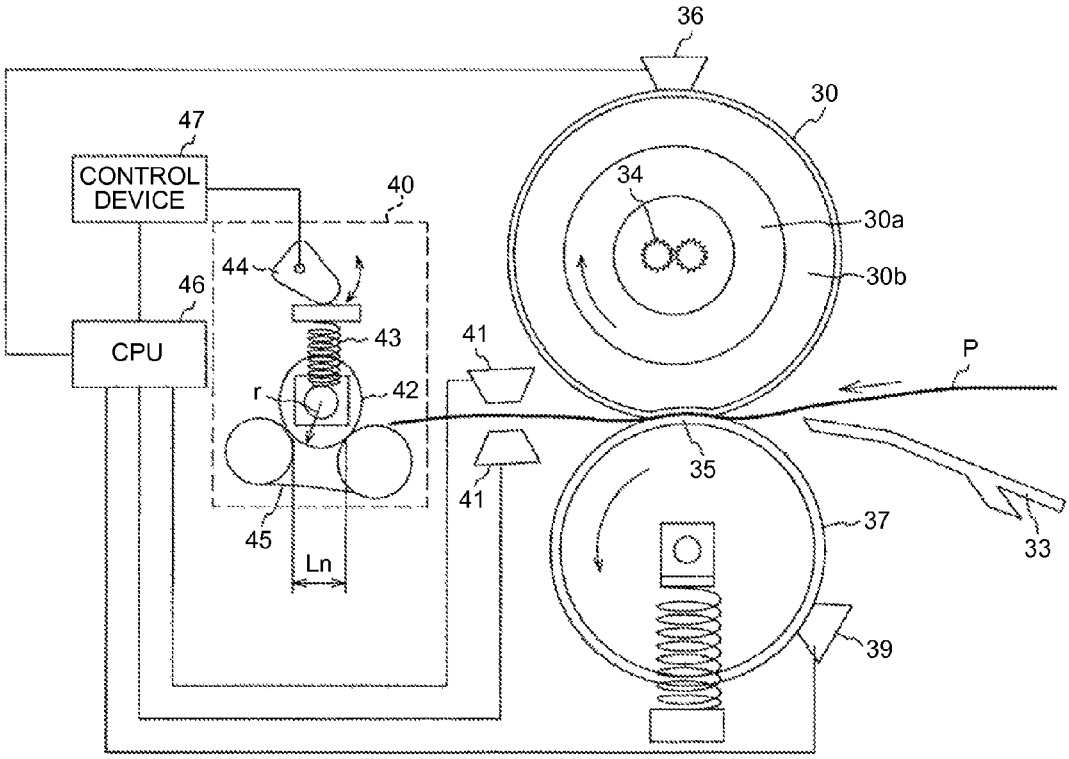
FIG. 2 is a diagram illustrating a schematic configuration around a fixing device and a curl correction device in an image forming unit according to a first embodiment.

FIG. 2 is a diagram illustrating a schematic configuration around a fixing device and a curl correction device in the image forming apparatus according to a first embodiment. Hereinafter, a case of using paper as an example of a recording medium will be described. Examples of the recording medium may include paper, processed paper (coated paper), film, and the like.

As illustrated in FIG. 2, the fixing device of the first embodiment includes the heating roller 30, and the pressing roller 37 facing the heating roller 30. In the heating roller 30, a resin layer 30*b* such as a fluorine resin (PFA), which has heat resistance property and excellent release property, is formed on a peripheral surface of a pipe-shaped core metal 30*a*. A heater 34 is provided inside the pipe-shaped core metal 30*a*, and a temperature sensor 36 is disposed in contact with the peripheral surface of the resin layer 30*b*.

As the heater 34, a variety of heaters, such as a halogen heater and an electromagnetic induction heater may be used. The heating roller 30 and the pressing roller 37 rotate in a direction indicated by an arrow of FIG. 2 to convey the paper P to and pass the paper P through a nip portion (pressing portion) 35 where these are pressed. At the entrance side of the nip portion 35, an entrance guide 33 that directs a leading end of the paper to the nip portion 35 is installed.

The above-described fixing device guides the paper P by the entrance guide 33 after the image transfer, and passes the paper P through the nip portion 35 between the heating roller 30 and the pressing roller 37 so that the transferred multicolor toner image is fixed on the paper P by heat and pressure. The temperature sensor 36 measures a surface temperature of the heating roller 30, performs an appropriate temperature control according to the measurement signal, and performs turning-on/off of or control of a current value of the heater 34, so that the surface temperature of the heating roller 30 is constantly maintained. A temperature range of the heating roller 30 is set to about 100° C. to 180° C., generally around 160° C. Also, a temperature sensor 39 is provided at the pressing roller 37 so as to make it possible to measure a surface temperature of the pressing roller 37.

A temperature/humidity sensor 41 is installed in a paper conveying direction of the nip portion 35 of the fixing device (downstream of the process). It is preferable to use a sensor having a response performance of 1 second or less as the temperature/humidity sensor 41. In terms of improvement in printing throughput, it is more preferable to use a sensor having a response performance of 0.1 second or less.

For example, a part serving as a humidity sensor of the temperature/humidity sensor may use a capacitance type humidity sensor in which a capacitor is formed using a polymer film as dielectric, and moisture absorption/desorption is changed to an electrical signal as a change in electrostatic capacitance. Alternatively, it is possible to use an electrical resistance type humidity sensor in which an electrode is formed on a substrate, from a moisture-sensitive polymer material and a stable metal, and a change in resistance by moisture at the electrode is changed to an electrical signal. As a temperature sensor of the temperature/humidity sensor, a thermistor or a band gap type temperature sensor may be used. Any type of sensors using another principle or having another configuration may be used as long as the sensors have a similar performance.

Referring to FIG. 2, the paper P having passed through the nip portion 35 between the heating roller 30 and the pressing roller 37 passes through the vicinity of the temperature/humidity sensor 41. Since the paper P having passed through the fixing device is heated to about 80° C. to 120° C. by the heating roller 30, moisture the paper P contains is vaporized and discharged from both sides in the air. The temperature/humidity sensor 41 captures the vapor, detects a temperature/humidity of the vapor near the surface of the paper P, and outputs the detected temperature/humidity to a central processing unit (CPU) 46.

The CPU 46 calculates the temperature and moisture content of the paper P by using both of the temperature output value and the humidity output value of the area where the paper P has passed through the temperature/humidity sensor 41. The output values are sampled in synchronization with the timing at which the paper P passes between the temperature/humidity sensors 41 and 41. In the case of response performance enough to perform a plurality of samplings during a period where the paper P passes through the temperature/humidity sensor 41, an average value over a plurality of sampling points may be used. Also, the timing at which the paper P passes through the temperature/humidity sensor 41 may be measured from a paper feeding timing, or a paper feeding sensor may be used.

Also, the CPU 46 may be connected to the temperature sensor 36 at the heating roller 30 and the temperature sensor 39 at the pressing roller 37 and may obtain temperature output values thereof.

A control device 47 controls the operation of the curl correction device 40 by using a control value according to the calculated curl correction efficiency. Incidentally, a method of calculating the curl correction efficiency will be described below in detail.

The curl correction device 40 includes an endless belt 45 forming a conveying path of the paper P, a conveying driving roller 42 abutting against a stretched surface of the endless belt 45 and rotating in a direction corresponding to the conveying direction of the paper P, a spring 43, and a cam 44.

In order to correct curl generated in the paper P, the curl correction device 40 is controlled by the control device 47 such that the cam 44 is driven to apply a force to the spring 43 and thereby it is made possible to change a winding angle of the endless belt 45 with respect to the conveying driving roller 42. Therefore, a curl correction according to a predicted curl amount and curl correction efficiency is performed on the paper P.

The inventors of the present application found that the correction effect of the curl correction device 40 changes according to viscoelasticity of the paper, and the viscoelasticity changes according to the temperature and moisture content of the paper, and also found that the moisture content of the paper has correlation with the humidity near the surface of the paper.

When defining the curl correction efficiency as relating to the correction effect of the curl correction device 40, the curl correction efficiency can be defined as (curl amount the curl correction device generates (can correct) in a certain environment)/(curl amount the curl correction device generates (can correct) in a reference environment).

The configuration of the curl correction device 40 is not limited to the illustrated embodiment, and a curl correction device of any configuration can also be used as long as the curl correction device can control a predetermined curl correction amount.

Next, the hardware configuration of the image forming apparatus of the present embodiment will be described.

Figure 3:
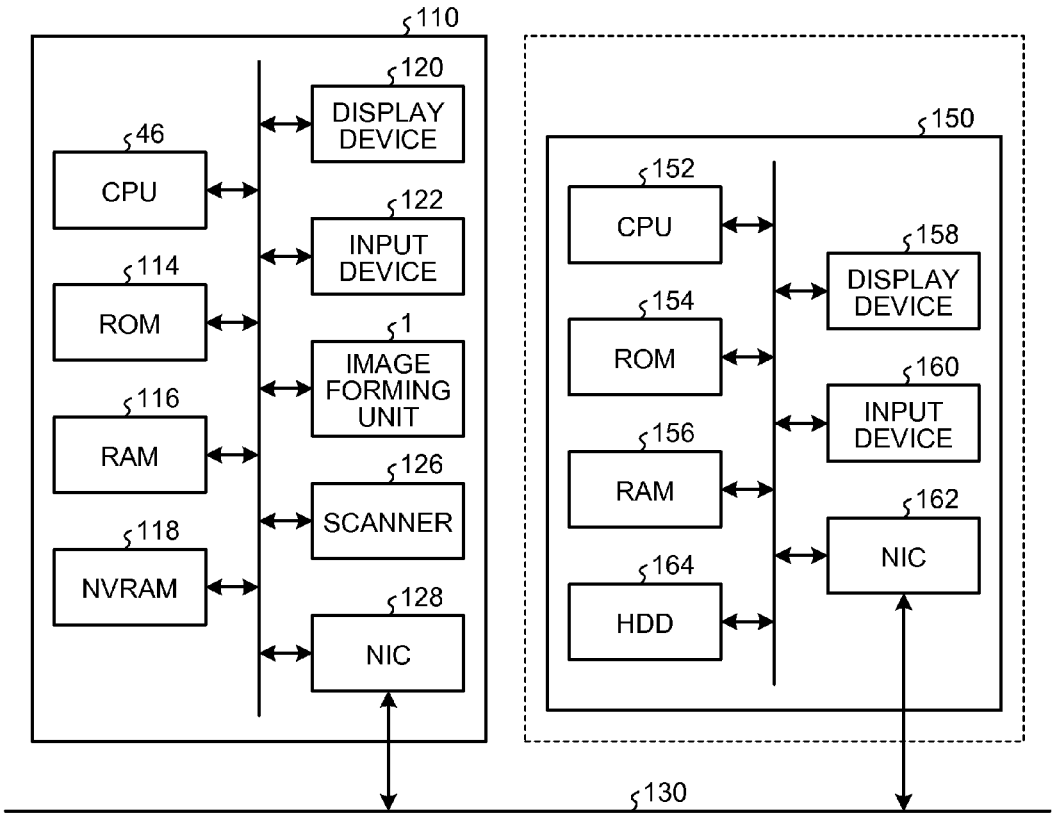
FIG. 3 is a diagram illustrating a hardware configuration of the image forming apparatus according to the embodiment.

FIG. 3 is a diagram illustrating the hardware configuration of the image forming apparatus according to the present embodiment.

The image forming apparatus 110 of the present embodiment includes the CPU 46, a read only memory (ROM) 114, a random access memory (RAM) 116, and a non volatile-RAM (NV-RAM) 118.

The CPU 46 controls the image forming operation, such as image formation and paper conveyance, and the operation of the curl correction device 40. The ROM 114 stores Basic Input/Output System (BIOS) or the like. The RAM 116 provides the runspace of the CPU 46.

The NV-RAM 118 stores system configuration information, a function or table of a shrinkage ratio with respect to a type, thickness, temperature, and moisture content of paper, a table of curl correction efficiency, which is described later, a table of stress relaxation characteristics, a table of reference control values, and so on. Also, the NV-RAM 118 stores a relational expression or table of temperature/humidity near the surface of the paper and moisture content, data for calculation of a control value to adjust the curl correction device 40. The table refers to a set of data expressed in a tabular format, but is not limited thereto. The table refers to aggregation of data. Therefore, the system configuration information or the function or table of a shrinkage ratio with respect to a type, thickness, temperature, and moisture content of paper store system configuration information or information of a shrinkage ratio with respect to a type, thickness, temperature, and moisture content of paper. Also, the table of curl correction efficiency stores information of curl correction efficiency, the table of stress relaxation characteristic stores information of stress relaxation characteristics, and the table of reference control values stores information of a reference control value. Also, the relational expression or table of temperature/humidity near the surface of the paper and moisture content means storing information of the relationship between the temperature/humidity near the surface of the paper and the moisture content.

The image forming apparatus 110 further includes a display device 120 and an input device 122 such as an operation panel, and the above-described image forming unit 1 which performs the image forming operation. Also, the image forming apparatus 110 further includes a scanner 126 which performs an image reading operation, and a network interface card (NIC) 128 which connects the image forming apparatus 110 to a network 130.

The image forming apparatus 110 illustrated in FIG. 3 reads a program stored in the storage device, such as the ROM 114, the NV-RAM 118, and the SD card, and deploys the read program in a memory area of the RAM 116 which provides the working area of the CPU 46. Thereby, each function unit and each processing, which are described later, are realized.

The network 130 may be constituted by a local area network (LAN) or a virtual private network (VPN) by Ethernet (registered trademark) or transaction protocol such as Transmission Control Protocol/Internet Protocol (TCP/IP), or a wide area network (WAN) connected using a dedicated line. However, the configuration of the network 130 is not specially limited. The network 130 may include Internet to be connected through a router which is not illustrated. Also, the network 130 may be configured as a wired network, a wireless network, or a hybrid network.

In FIG. 3, a hardware configuration of a server apparatus 150 is further illustrated. The server apparatus 150 is connected to the network 130.

The server apparatus 150 centrally manages a function or table of a shrinkage ratio with respect to a type, thickness, temperature, and moisture content of paper, a table of curl correction efficiency, which is to be described below, a table of stress relaxation characteristics, or a table of reference control values. Also, the server apparatus 150 centrally manages a relational expression or table of temperature/humidity near the surface of the paper and moisture content, and data for calculation of a control value to adjust the curl correction device 40. The server apparatus 150 has a server function of transmitting update data appropriately according to a request from the image forming apparatus through the network 130.

The server apparatus 150 is configured as computer equipment, such as a personal computer, a workstation, a blade server, and an image forming apparatus having a server function. Therefore, the server apparatus 150 includes a CPU 152, a ROM 154, a RAM 156, a displaying device 158 such as a display device, an input device 160 such as a mouse and a keyboard, an NIC 162, and an HDD 164. Thereby, the server function of providing the function or table of a shrinkage ratio with respect to a type, thickness, temperature, and moisture content of paper, which has been described above, and the table of curl correction efficiency, the table of stress relaxation characteristics, and the table of reference control values, which are described later, is realized. Also, the server function of providing the relational expression or table of temperature/humidity near the surface of the paper and moisture content, and data for calculation of a control value to adjust the curl correction device 40 is realized.

Figure 4:
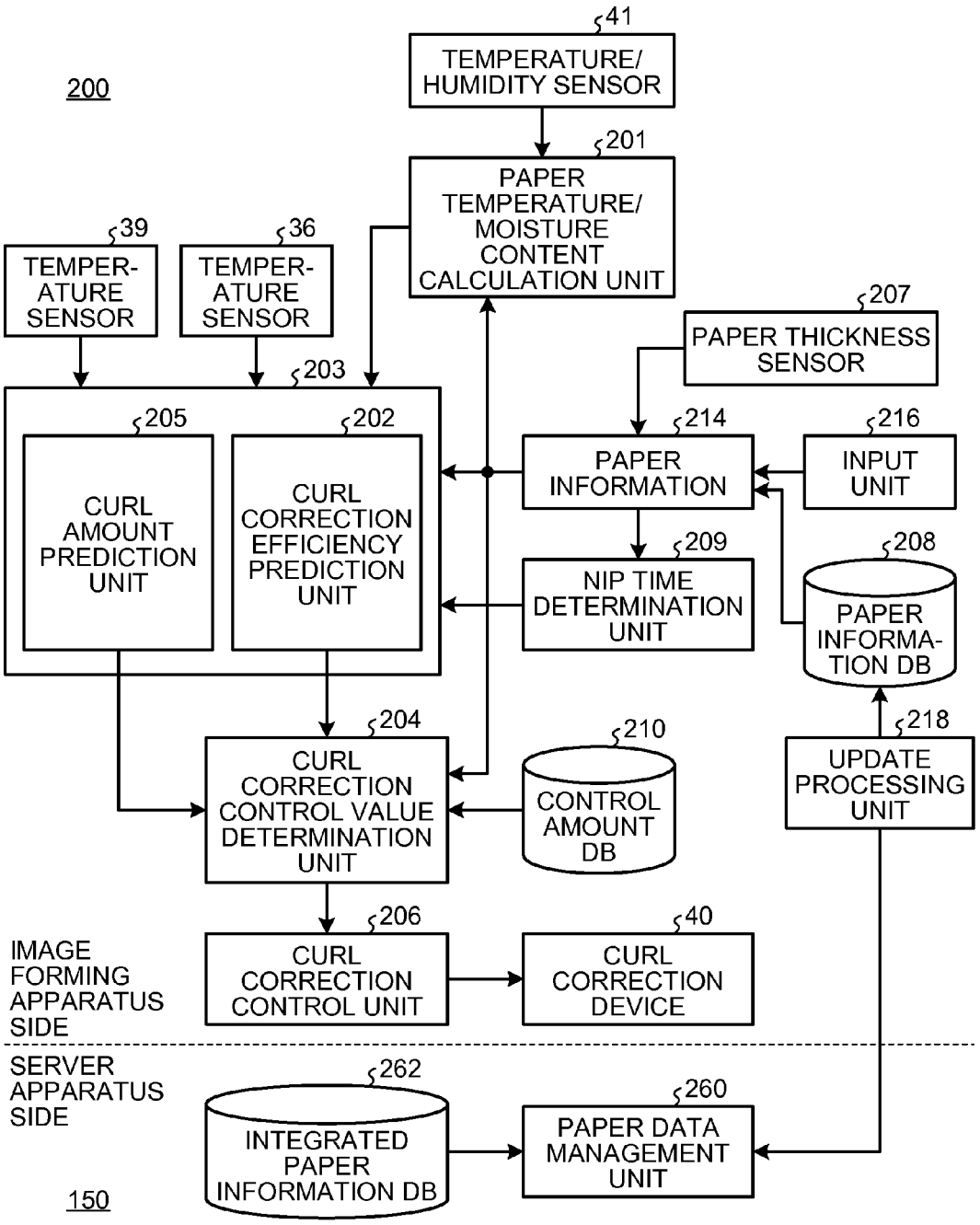
FIG. 4 is a functional block diagram of the image forming apparatus and a server apparatus according to the embodiment.

FIG. 4 is a functional block diagram of the image forming apparatus and the server apparatus according to the present embodiment.

As illustrated in FIG. 4, a functional block 200 of the image forming apparatus includes a curl correction amount calculation unit 203, a curl correction control value determination unit 204, a curl correction control unit 206, and an input unit 216.

The curl correction amount calculation unit 203 includes a curl amount prediction unit 205 and a curl correction efficiency prediction unit 202. The input unit 216 receives a type of paper, which is currently supplied to the paper cassettes 51 and 52, and so on from an operator. These are held as paper information (recording medium information) 214 in an appropriate storage area of the RAM 116, the NV-RAM 118 or the like. The paper information 214 holds a type identification value identifying the type of the paper for each paper cassette. The type identification value specifies the paper set in the paper cassette. The value designated as the type identification value may include a value representing that the type of the paper is unknown, a classification value representing a paper class, such as high-quality paper, recycled paper, semi-glossy paper, glossy paper, or matte paper, and information representing whether the paper is long grain or short grain. Also, in the case where no paper thickness sensor 207 is provided, a thickness value designating the thickness of the paper is also included.

A paper temperature/moisture content calculation unit 201 obtains the temperature and humidity near the surface of the paper by the temperature/humidity sensor 41, and obtains the temperature and moisture content of the paper by the function or table to calculate the temperature and moisture content of the paper. The paper thickness information is read from the paper thickness sensor 207 or a paper information DB 208. Fixing nip time corresponding to paper heating time is obtained by calculation or by referring to tabulated data in a nip time determination unit 209 from information of the paper information 214. Also, nip time of the curl correction device 40 is obtained in the similar manner. The curl correction efficiency prediction unit 202 obtains corresponding curl correction efficiency from the temperature and moisture content of the paper, the paper information 214, and the nip time of the curl correction device 40 by referring to the curl correction efficiency table contained in the paper information DB 208.

As illustrated in FIG. 2, when assuming that a nip width of the curl correction device 40 is Ln and a paper conveying speed is Vp, curl correction nip time tc can be expressed as the following Formula (1).

$$tc = \frac{Ln}{Vp} \tag{1}$$

Assume that the curl amount generated when the paper of the type Ii, the temperature Ti, and the moisture content Mi has passed through the curl correction device 40 in the nip time tci which is the reference in the curl correction device 40 is RCi. When assuming that a curl amount in the case where temperature and moisture content of paper is different from that is RCx, curl correction efficiency $\alpha$ can be expressed as the following Formula. Here, the curl amount is a curvature when the curl is considered as an arc.

$$\alpha = \frac{RCx}{RCi} \tag{2}$$

A curl correction efficiency table is exemplarily illustrated in FIG. 5. A matrix is configured by the nip time tc of the curl correction device 40, the code I representing the type of the paper, and the moisture content M and temperature T of the paper, and has curl correction efficiency associated with these. The curl correction efficiency may be calculated by an approximate expression of the relationship between change of each condition and curl correction efficiency, rather than calculating the curl correction efficiency stepwise in each condition range. The curl correction efficiency table is experimentally obtained by changing the curl correction nip time tc, the type of the paper, and the moisture content M and temperature T of the paper. The type of the paper, for example, is classified into high-quality paper, recycled paper, semi-glossy paper, glossy paper, and matte paper.

Next, the method of calculating the curl correction efficiency from the stress relaxation characteristic of the paper will be described.

Figure 6:
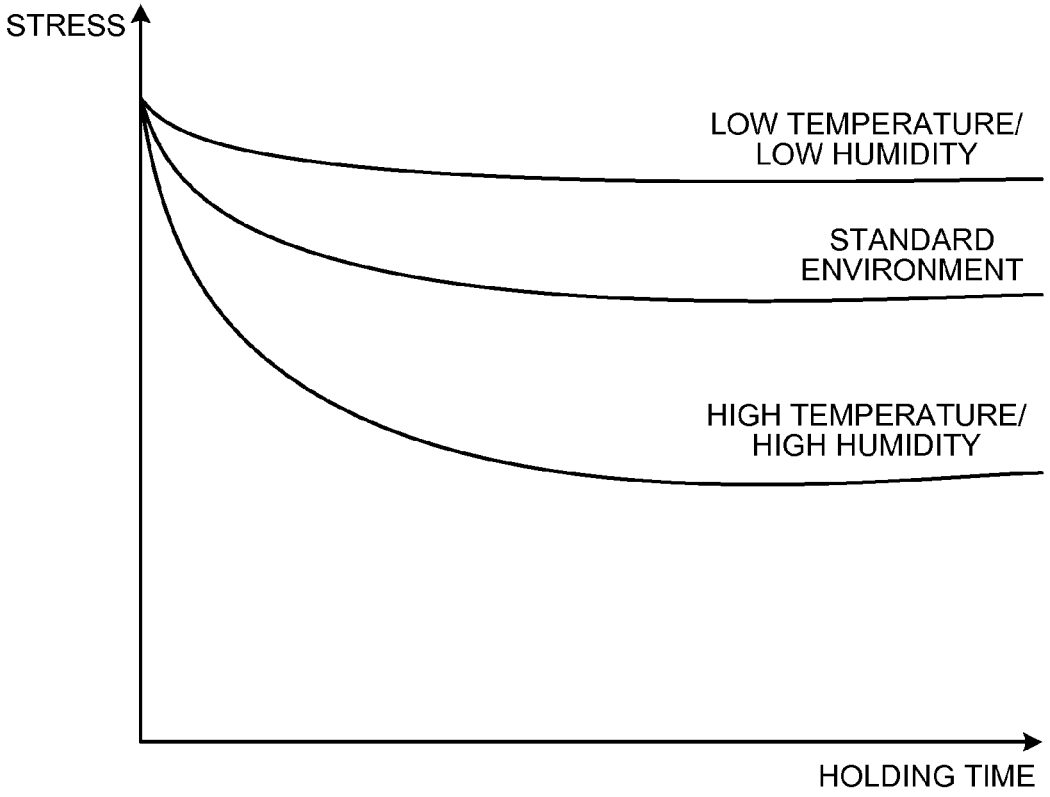
FIG. 6 is a diagram illustrating a stress relaxation characteristic of a paper.

FIG. 6 illustrates the stress relaxation characteristic of the paper. In FIG. 6, a horizontal axis represents time, and a vertical axis represents stress. If a certain deformation is given to paper, a stress is generated. Since the paper is a viscoelastic body, the paper undergoes stress relaxation as illustrated in the drawing. It can be considered that the stress relaxation leads to the generation of residual strain by plastic deformation, and the curl correction uses the stress relaxation of the paper. When assuming that the stress of the paper is SR, the stress relaxation can be expressed as the following generalized Maxwell model. Sz is a stress after infinite time, and τ is a time constant.

$$SR(t) = Sz + \sum_{i}^{N} S_i \cdot \exp\left(-\frac{t}{\tau_i}\right) \tag{3}$$

Each constant changes according to the temperature and moisture content of the paper. Therefore, when assuming that the time, the temperature, and the moisture content are t, T, and M, respectively, the stress can be expressed as follows.

$$SR(t, T, M) = Sz(T, M) + \sum_{i}^{N} S_i(T, M) \cdot \exp\left(-\frac{t}{\tau_i(T, M)}\right) \tag{4}$$

As illustrated in FIG. 2, assume that a radius of a portion of the curl correction device where the paper passes is r. When assuming that the thickness of the paper is tp and Young's modulus is Ep, initial stress SR(0, T, M) received by the paper can be expressed as the following Formula. Since Young's modulus also changes according to the temperature and humidity of the paper, the initial stress can be expressed as a function of temperature T and moisture content M as follows:

$$SR(0, T, M) = \frac{tp}{2 \cdot r} Ep(T, M) \tag{5}$$

For Sz(T, M), Si(T, M), and τ(T, M) in Formula (4), data is obtained for a representative paper type, some temperature T and humidity M, and a table or function related to the temperature T and the humidity M is obtained. Also, for Young's modulus Ep, a table or function related to the temperature T and the humidity M is obtained with respect to a representative paper type.

The stress relaxation characteristic table is exemplarily illustrated in FIG. 7. A matrix is configured by the code I representing the type of the paper, the moisture content M of the paper, and the temperature T of the paper, and has constants associated with these. If i of Formula (4) is set to fourth order, Formula (4) can be sufficiently matched with an experimental value. Therefore, Si consists of S1 to S4, and τi consists of τ1 to τ4. Since there is no problem even when S1 to S4 are set to the same value, S1 to S4 are set to the same value, and τ1 to τ4 are set to different values. For simplicity, τ1 to τ4 may be changed only according to the type of the paper and be set to constant values with respect to the temperature and the moisture content. The stress relaxation table is experimentally obtained through a paper tension test in which the type of the paper, the moisture content M of the paper, and the temperature T of the paper are changed. Here, the type of the paper is also classified into high-quality paper, recycled paper, semi-glossy paper, glossy paper, and matte paper.

The method of calculating the curl correction efficiency from the stress relaxation characteristic will be described next.

The curl correction amount RC is equal to a curl amount after paper of a curl-free state has passed through the curl correction device 40, and is a curvature when curl is considered as an arc. When assuming that the nip time of the curl correction device 40 is tc and K is a constant, the curl correction amount RC is expressed as the following Formula.

$$RC(tc, T, M) = K\frac{SR(0, T, M) - SR(tc, T, M)}{SR(0, T, M)} \tag{6}$$

The curl amount RCi generated in the paper when having passed through the curl correction device 40 in the nip time tc which is the reference in the curl correction device 40 with the paper type Ii, the temperature Ti, and the moisture content Mi is obtained from Formula (6). The curl amount Rcx when the temperature and moisture content are different from the reference is calculated, and the curl correction efficiency α is obtained from Formula (2). In this method, since the curl correction efficiency can be finely obtained by calculation according to the curl correction nip time tc, the curl correction can be performed with high accuracy. Therefore, an image forming apparatus forming a recording medium with less curl can be obtained.

The curl amount prediction unit 205 appropriately obtains the output values from the temperature sensor 36 at the heating roller 30 and the temperature sensor 39 at the pressing roller 37, and also reads the paper information 214.

Also, a difference in temperature and humidity between the temperature/humidity sensors 41 disposed above and below the paper is obtained, and the temperatures and moisture contents of front and rear sides are obtained from the paper temperature/moisture content calculation unit 201.

Among the information included in the paper information 214, the paper thickness information is read by the paper thickness sensor 207, and the nip time corresponding to the paper heating time is obtained by calculation or by referring to tabulated data from the information of the paper information 214 in the nip time determination unit 209. The predicted curl amount is calculated by obtaining the shrinkage ratio with respect to the temperature and moisture content of the paper from the paper information DB 208. Since the temperature/humidity sensors 41 are disposed immediately after the fixing device and immediately before the curl correction device, the temperature of the paper and the moisture content of the paper can be known with high accuracy. Therefore, the curl amount prediction can also be performed with high accuracy.

The curl correction control value determination unit 204 determines a control value to perform a desired amount of curl correction in the curl correction device 40, from the curl amount obtained by the curl amount prediction unit 205 and the curl correction efficiency obtained by the curl correction efficiency prediction unit 202. The curl correction control unit 206 controls the curl correction device 40 such that the curl correction is performed according to the control value determined by the curl correction control value determination unit 204.

The table of the control value being the reference used by the curl correction control value determination unit 204 is created by changing the control value Xi in the temperature Ti and the moisture content Mi of the paper being the reference and obtaining the curl amount RC after the paper has passed through the curl correction device 40. The control amount DB 210 holds the table of the reference control value or the approximate expression which reproduces it. These may be held in the paper information DB 208.

FIG. 8 is the table of the control values Xi with respect to the predicted curl amounts Cr. The curl amount RC after the curl-free paper has passed through the curl correction device 40 is equal to the correctable curl amount. Therefore, the curl amount RC of the curl correction device 40, which was obtained in the experiment, is replaced with the predicted curl amount Cr after the fixing device. The nip width Ln also changes according to the control value. Therefore, the data of the nip width is also tabulated and is used to separately calculate a nip time tc. In addition to the high-quality paper, the recycled paper, the semi-glossy paper, the glossy paper, and the matte paper, the type of the paper is classified according to long grain, short grain, and thickness.

Regarding the relationship between the curl amount Cr and the control value Xi, the approximate expression may be obtained in advance, and the approximate expression may be used to determine the control value.

During the operation of the image forming apparatus, the correction control value Xn used in the curl correction device 40 is obtained by the following Formula (7) from the curl correction efficiency α according to the type, temperature and moisture content of the paper, which change as described above, and the reference control value Xi determined from the predicted curl amount Cr. It is assumed that the control value is such a value that the correction amount of the curl correction device 40 increases as the control value increases.

$$Xn = \frac{Xi}{\alpha} \tag{7}$$

Next, the process of updating the paper information DB in the image forming apparatus of the present embodiment will be described.

The functional block 200 of the image forming apparatus of the present embodiment may further include an update processing unit 218 as illustrated in FIG. 4. The update processing unit 218 performs update processing of data in the paper information DB 208 so as to cope with changes, such as the launch of a new product and the specification change of paper distributed on the market. Examples of the information contents include the function or table of the shrinkage ratio, the table of curl correction efficiency, the table of reference control values, the table of stress relaxation characteristics, and the relational expression or table of temperature/humidity near the surface of the paper and moisture content with respect to the type, thickness, the temperature and moisture content of the paper.

For example, the update processing unit 218 starts the update processing when the setting of the paper information 214 is changed through the input unit 216 and it is detected that there is no data for curl calculation or of curl correction efficiency corresponding to the type identification value of the changed setting. Also, the update processing unit 218 starts the update processing at a scheduled timing, regardless of the presence or absence of the setting change, or when there is an instruction from an operator.

In the update processing, the update processing unit 218 transmits the model identification value of the image forming apparatus, the function or table of the shrinkage ratio and the table of curl correction efficiency with respect to the necessary paper type, thickness, temperature, and moisture content, and so on, to a paper data management unit 260 of the server apparatus 150. Also, the update processing unit 218 transmits the table of stress relaxation characteristics, the table of reference control values, the relational expression or table of temperature/humidity near the surface of the paper and moisture content, and so on.

The paper data management unit 260 of the server apparatus 150 accesses an integrated paper information DB 262 in which data for curl calculation is made in database for each of various types of paper distributed on the market, and for each model. The paper data management unit 260 obtains data corresponding to the received model identification value and type identification value, and transmits the update data to the update processing unit 218 of the image forming apparatus.

The update processing unit 218 obtains the update data and updates data within the paper information DB 208. It is likely that the characteristics of the distributed products themselves will change over time. Therefore, in order to cope with such a change, it is preferable that expiration dates are designated to the data for curl calculation or the data of curl correction efficiency, which is to be updated, and the data are periodically updated to latest data.

Figure 9:
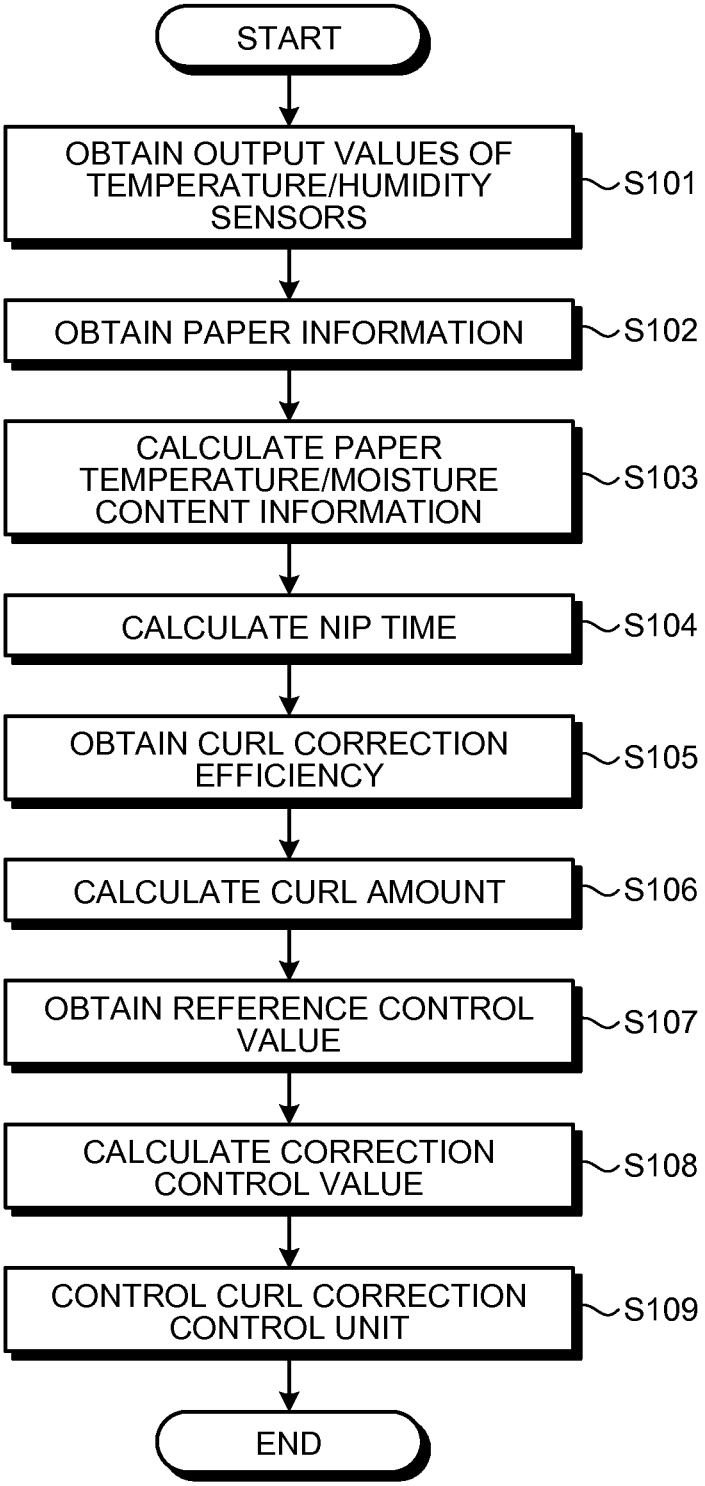
FIG. 9 is a flow chart illustrating a curl correction control operation.

Hereinafter, the curl correction control operation performed by the image forming apparatus of the present embodiment will be described. FIG. 9 is a flow chart illustrating the curl correction control operation performed by the image forming apparatus of the present embodiment. The operation illustrated in FIG. 9 is started in accordance with an appropriate timing at which the paper passes through the sensor or the fixing device. In step S101, the CPU 46 obtains the output values from the temperature/humidity sensors 41. In step S102, the CPU 46 reads the paper information and obtains the type identification value designated to the paper cassette which is the paper feeding source of the current process. In step S103, the CPU 46 obtains the temperature and moisture content of the paper from the obtained output values and the obtained type identification value.

In step S104, the CPU 46 calculates nip time from the paper information, the conveying speed corresponding to the paper information, and the nip width. In step S105, the CPU 46 obtains the curl correction efficiency from the curl correction efficiency table, based on the temperature and moisture content of the paper, and the nip time of the curl correction device 40, which are information obtained in the previous step. In step S106, the CPU 46 calculates the curl amount, based on temperature difference and humidity difference (moisture content difference) between front and rear sides of the paper, which are information obtained in the previous step, and so on. In step S107, the CPU 46 obtains the reference control value according to the curl amount from the control value table. In step S108, the CPU 46 calculates the control value after correction from the reference control value and the curl correction efficiency. In step S109, the CPU 46 controls the curl correction control unit 206 which performs the control of the curl correction device 40 to change the winding angle. Then, the operation is ended. After the curl correction control operation is ended, the paper is conveyed to the curl correction device 40, the curl of the paper is corrected with the set winding angle, and the paper is ejected onto the discharging tray 50.

Figure 10:
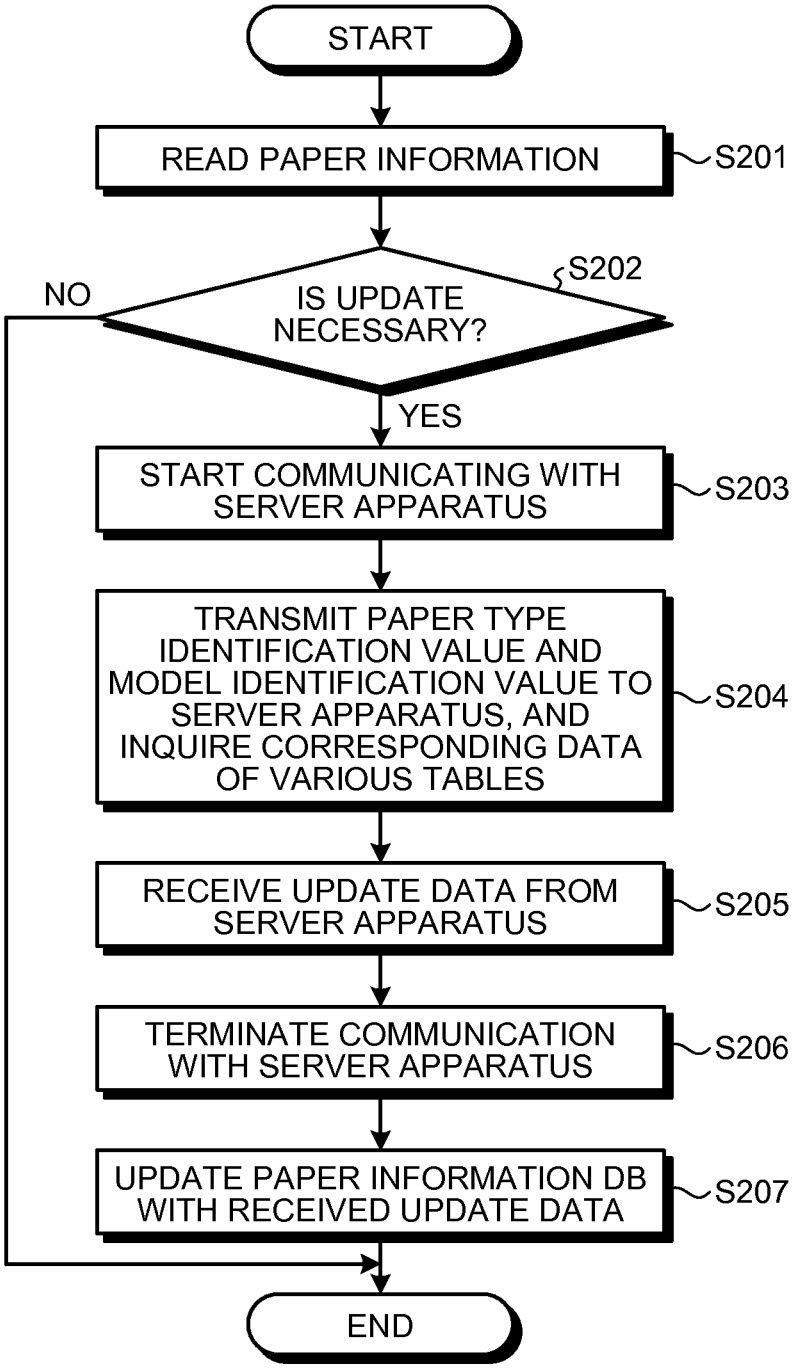
FIG. 10 is a flow chart illustrating an update process.

FIG. 10 is a flow chart illustrating the update processing performed by the image forming apparatus of the present embodiment. The update processing illustrated in FIG. 10 is started after the setting change of the paper information 214 is detected, after the arrival of the scheduled timing is detected regardless of the setting change, or after the instruction to perform the update processing from the operator is detected. When the updating processing is started, the update processing unit 218 reads the paper information 214 in step S201 and determines in step S202 whether the update is necessary.

The update is determined as necessary when a range corresponding to a newly set type identification value does not exist in the function or table of the shrinkage ratio with respect to the paper type, thickness, temperature, and moisture content in the paper information DB 208. Also, the update is determined as necessary when table data whose expiration date has expired exists in the function or table of the shrinkage ratio with respect to the paper type, thickness, temperature, and moisture content in the paper information DB 208. Also, the update is determined as necessary when a range corresponding to a newly set type identification value does not exist in the table of curl correction efficiency and the table of stress relaxation characteristics, or table data whose expiration date has expired exists therein. Also, the update is determined as necessary when a range corresponding to a newly set type identification value does not exist in the table of reference control values and the relational expression or table of the temperature/humidity near the surface of the paper and moisture content, or table data whose expiration date has expired exists therein.

When the update is determined as necessary in step S202 (YES), the processing proceeds to step S203. Subsequently, in step S203, the update processing unit 218 starts communicating with the server apparatus 150. In step S204, the update processing unit 218 transmits the paper type identification value, for which the update is determined as necessary, and the model identification value of the relevant image forming apparatus to the server apparatus, and inquires the corresponding constant, function or table.

In step S205, the update processing unit 218 receives update data, including the inquired function or table of the shrinkage ratio and table of curl correction efficiencies with respect to the paper type, thickness, temperature, and moisture content, from the server apparatus. Also, the update processing unit 218 receives update data, including the table of stress relaxation characteristics, the table of reference control values, and the relational expression or table of temperature/humidity near the surface of the paper and moisture content, from the server apparatus. In step S206, the communication with the server apparatus is terminated. In step S207, the update processing unit 218 updates data within the paper information DB 208, based on the received update data, and ends the update processing. On the other hand, when the update is determined as unnecessary in step S202 (NO), the processing is directly branched to step S208, and the update processing is ended.

Figure 11:
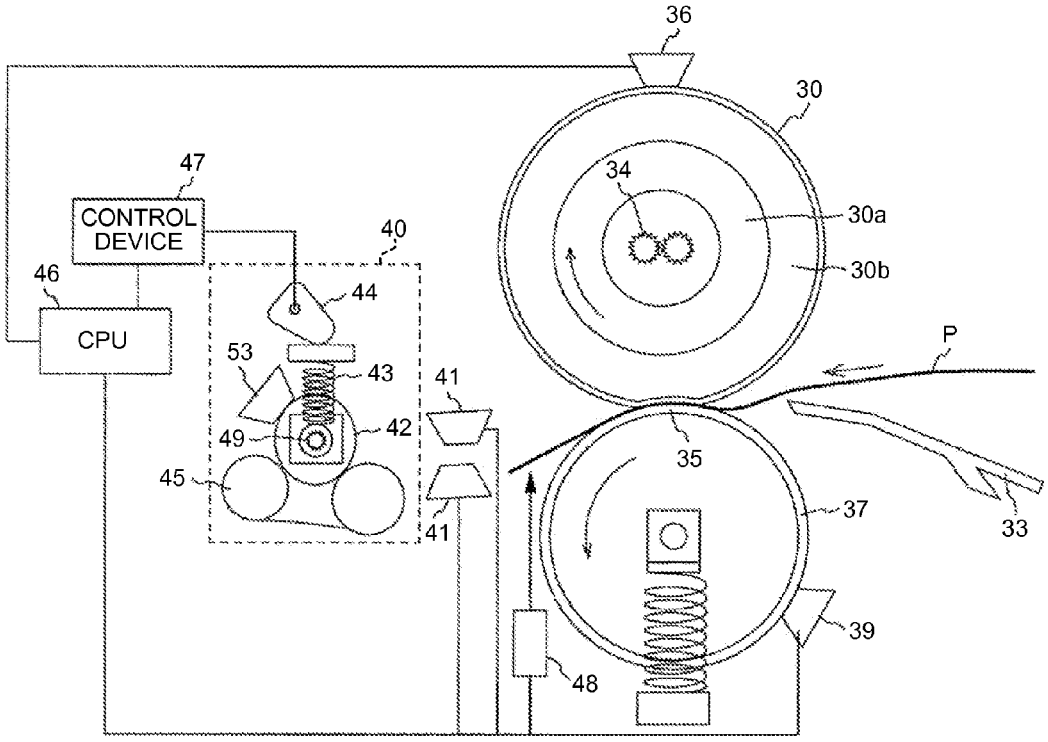
FIG. 11 is a diagram illustrating a schematic configuration around a fixing device and a curl correction device in an image forming unit according to a second embodiment.

FIG. 11 is a diagram illustrating a schematic configuration around a fixing device and a curl correction device according to a second embodiment. Also, the same reference numerals are assigned to the same portions as those of FIG. 2, and descriptions thereof will not be repeated.

The second embodiment illustrated in FIG. 11 differs from the first embodiment illustrated in FIG. 2 in that the second embodiment includes a displacement sensor 48 which is a curl amount measurement device measuring a curl amount of paper P after the fixing device performs the fixation. Also, the second embodiment illustrated in FIG. 11 differs from the first embodiment illustrated in FIG. 2 in that the second embodiment includes a roller heater (heating unit) 49 heating the conveying driving roller 42 and a roller temperature sensor (temperature sensor unit) 53 detecting the temperature of the conveying driving roller 42.

The displacement sensor 48 is connected to the CPU 46 and measures a distance to the surface of the paper at constant time intervals. Feed rate and height information are obtained from the paper conveying speed, and the CPU 46 can calculate the two-dimensional shape of the paper, that is, the curl amount Cr, from the information (measurement result). If a protrusion amount of the leading end of the paper from the pressing portion of the fixing device increases, the leading end of the paper P is inserted into the curl correction device 40. Therefore, the curl amount becomes unclear. For this reason, in the second embodiment, the curl amount is predicted by measuring a distance to the surface of the paper at a position, at which the leading end of the paper is not confined.

On the other hand, the roller heater 49 heats the conveying driving roller 42 if the temperature of the paper P is low and the moisture content of the paper P is low when the temperature and moisture content of the paper P are measured after the fixing device performs the fixation. The heating control of the roller heater 49 is performed by the control device 47 based on the temperature and moisture content of the paper P. As the temperature of the paper P increases, stress relaxation of the paper P increases and the correction efficiency increases. Therefore, the correction efficiency can be increased by heating the conveying driving roller 42.

In this case, the temperature of the conveying driving roller 42 is detected by the roller temperature sensor 53, and the CPU 46 corrects the temperature of the paper P based on the temperature information, and calculates the curl correction efficiency.

According to the second embodiment configured as above, the curl amount is directly measured immediately after the fixing device performs the fixation. Therefore, the curl correction amount can be obtained with higher accuracy. Also, even when the temperature and moisture content of the paper P are low, the stable high-accuracy curl correction can be realized.

According to the image forming apparatus and the curl correcting method of the embodiments described above, the change in the temperature and moisture content of the paper after the fixing device is measured immediately after fixation and immediately before the curl correction device and the correction amount of the curl correction device can be appropriately controlled according to the change in the curl correction efficiency. Hence, the stable curl correction can be realized without being affected by the operating state of the image forming apparatus, and the high-reliability image forming apparatus without curling can be provided. Furthermore, the update of the data for calculation of the curl correction efficiency is facilitated and the stable curl correction can be realized over a long period of time according to various types of paper.

Also, in the present embodiment, the viscoelasticity information of the used paper is read, and the curl correction efficiency is obtained according to the paper. Therefore, the accuracy of the curl correction efficiency can be improved. The paper information specifying the viscoelastic characteristic of the paper may include a value representing the thickness of the paper, a value identifying the classification of the paper, or a value identifying the unique type of the paper.

Also, in the present embodiment, the temperature and moisture content of the paper are obtained from the output values of the temperature/humidity sensors, and the table associating them with the curl correction efficiency is used. Therefore, the high-accuracy curl correction efficiency can be easily obtained.

Also, in the present embodiment, by providing the thickness sensor which detects the thickness of the conveyed paper, the thickness information of the paper can be obtained by the thickness sensor.

Also, conventionally, in order to predict the effect of the curl correction, data to calculate the effect of the unique curl correction of the paper is required. For example, the paper, which is the existing type but is available in the market, does not always have a constant characteristic. Therefore, the current characteristic may be different from the previous data. Also, if considering coping with new products, data to calculate the effect of the curl correction needs to be updated. Updating data on the imaging device being already running in the market has a problem in that a lot of time and effort is required.

On the other hand, the image forming apparatus of the present embodiment can communicate with the server apparatus connected through the network and can perform updating processing of the parameters or table of the function to calculate the curl correction efficiency. Therefore, it is possible to cope with the case where new paper is used and cope with the change in temporal characteristic of the distributed paper. Also, the working load of the manager at that time can be significantly reduced.

In the present embodiment, the tandem type printer having the color printing function has been described as one example of the image forming apparatus. However, the present invention can also be applied to any image forming apparatus as long as the image forming apparatus includes a fixing device which melts a toner image by heat and fixes the toner image on the paper, and a curl correction device which corrects deformation such as curl of the paper.

Also, the abovementioned function can be realized by a program, which is described with legacy program languages or object-oriented program languages, such as assembler, C, C++, C#, or Java (registered trademark), and can be executed by a computer. Also, the program can be stored in a recording medium, which can be read by a device, such as a ROM, an EEPROM, an EPROM, a flash memory, a flexible disk, a CD-ROM, a CD-RW, a DVD-ROM, a DVD-RAM, a DVD-RW, a Blue-ray disk, an SD card, or an MO. Alternatively, the program can be distributed over electric telecommunication lines.

Also, in the present embodiment, the paper has been described as one example of the recording medium. However, any recording medium other than the paper can also be applied as the recording medium as long as the temperature and moisture content can be calculated from temperature and humidity output values output from a temperature/humidity sensor unit.

According to one aspect of the present invention, an appropriate and accurate curl correction can be realized.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a fixing device which causes a recording medium to pass through a heated pressing portion and fixes a toner image formed on the recording medium;

a curl correction device which corrects curl generated in the recording medium having passed through the fixing device;

a temperature/humidity sensor unit which is installed in a conveying path between the fixing device and the curl correction device, and detects and outputs temperature and humidity near a surface of the recording medium being conveyed;

a calculation unit which calculates temperature and moisture content of the recording medium from temperature and humidity output values output from the temperature/humidity sensor unit, and calculates curl correction efficiency of the curl correction device from the temperature and moisture content of the recording medium;

a control value determination unit which determines a control value to perform a curl correction in the curl correction device, based on the curl correction efficiency calculated by the calculation unit; and a control unit which controls the curl correction device by the control value determined by the control value determination unit.

2. The image forming apparatus according to claim 1, comprising a storage unit which stores information representing a relationship between the curl correction efficiency and the control value, wherein the control value determination unit determines the control value such that a curl correction amount is provided to remove a curl amount predicted by the information stored in the storage unit.

3. The image forming apparatus according to claim 1, wherein the calculation unit reads recording medium information specifying a stress relaxation characteristic of the recording medium which is input to the image forming apparatus, and calculates the curl correction efficiency according to the recording medium information.

4. The image forming apparatus according to claim 1, wherein the calculation unit calculates the curl correction efficiency from temperature and humidity output values output from the temperature/humidity sensor unit, temperature and moisture content calculated from the temperature and humidity output values, and thickness information of the recording medium.

5. The image forming apparatus according to claim 1, comprising a curl amount measurement unit which is installed in an conveying path between the fixing device and the curl correction device and measures a curl amount of the recording medium which is generated in the fixing device, wherein the control value determination unit determines the control value based on the measurement result of the curl amount measurement unit.

6. The image forming apparatus according to claim 1, wherein the curl correction device comprises:

a conveying unit which conveys the recording medium;

a heating unit which heats the conveying unit;

a temperature sensor unit which detects a temperature of the conveying unit; and a heating control unit which controls the heating unit, wherein the heating control unit controls the heating unit based on temperature and moisture content of the recording medium, and the calculation unit performs a correction of the curl correction efficiency based on temperature information output from the temperature sensor unit.

7. The image forming apparatus according to claim 1, comprising an updating unit which communicates with a server apparatus connected through a network and performs an update processing of information stored in a storage unit and representing a relationship between the curl correction efficiency and the control value.

8. The image forming apparatus according to claim 1, comprising a thickness sensor which detects a thickness of the recording medium being conveyed.

9. The image forming apparatus according to claim 8, wherein the calculation unit calculates the curl correction efficiency according to a conveying speed of the recording medium which is determined according to the thickness output by the thickness sensor.

10. A curl correcting method performed by an image forming apparatus including a fixing device which causes a recording medium to pass through a heated pressing portion and fixes a toner image formed on the recording medium, and a curl correction device which corrects curl generated in the recording medium having passed through the fixing device, the curl correcting method comprising:

by a temperature/humidity sensor unit installed in a conveying path between the fixing device and the curl correction device, detecting and outputting temperature and humidity near a surface of the recording medium being conveyed in the conveying path;

by a calculation unit, calculating temperature and moisture content of the recording medium from temperature and humidity output values output from the temperature/humidity sensor unit;

by the calculation unit, calculating curl correction efficiency of the curl correction device from the temperature and the moisture content;

by a control value determination unit, determining a control value to perform a curl correction in the curl correction device, based on the curl correction efficiency calculated by the calculation unit; and by a control unit, controlling the curl correction device by the control value.

* * * * *